US009441810B2

(12) United States Patent
Kennedy et al.

(10) Patent No.: US 9,441,810 B2
(45) Date of Patent: Sep. 13, 2016

(54) COOKING HOOD LED LIGHT

(71) Applicant: Kason Industries, Inc., Newnan, GA (US)

(72) Inventors: Mark A Kennedy, Newnan, GA (US); Vincent R Iacovelli, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 0 days.

(21) Appl. No.: 13/790,277

(22) Filed: Mar. 8, 2013

(65) Prior Publication Data

US 2014/0254167 A1 Sep. 11, 2014

(51) Int. Cl.

| | |
|---|---|
| ***F21V 29/00*** | (2015.01) |
| ***F21V 7/00*** | (2006.01) |
| ***F21V 7/04*** | (2006.01) |
| ***F21V 13/04*** | (2006.01) |
| ***F24C 15/20*** | (2006.01) |
| *F21V 33/00* | (2006.01) |

(52) U.S. Cl.

CPC ..... *F21V 7/041* (2013.01); *F21V 7/00* (2013.01); *F21V 13/04* (2013.01); *F24C 15/2064* (2013.01); *F21V 33/0044* (2013.01)

(58) Field of Classification Search

CPC ..... F24C 15/20; F24C 15/2021; E04B 9/02; F21V 15/00; F21V 15/01; F21S 8/02; F21S 8/026

USPC ..... 126/229 R; 55/DIG. 36; 236/49.3; 169/65; 210/538

See application file for complete search history.

(56) References Cited

U.S. PATENT DOCUMENTS

| | | | | |
|---|---|---|---|---|
| 1,331,018 | A * | 2/1920 | Luthy | 429/143 |
| 4,143,645 | A * | 3/1979 | Blumberg | 126/299 D |
| 4,738,244 | A * | 4/1988 | Welsh | 126/299 R |
| 4,987,882 | A | 1/1991 | Kaufman | |
| 5,139,009 | A | 8/1992 | Walsh | |
| 5,472,342 | A | 12/1995 | Welsh, II et al. | |
| 5,642,784 | A | 7/1997 | Guay et al. | |
| 5,718,219 | A | 2/1998 | Boudreault | |
| 6,554,451 | B1 * | 4/2003 | Keuper | F21V 5/02 362/237 |
| 7,442,119 | B2 | 10/2008 | Fluhrer | |
| 7,654,258 | B2 | 2/2010 | Negandhi et al. | |
| 7,682,051 | B2 * | 3/2010 | Xiao et al. | 362/364 |
| 7,815,327 | B2 | 10/2010 | Shamshoian | |
| 8,022,641 | B2 * | 9/2011 | Janik et al. | 315/297 |
| 8,070,325 | B2 * | 12/2011 | Zampini et al. | 362/294 |
| 2004/0221839 | A1 * | 11/2004 | Plankl et al. | 126/299 D |
| 2004/0246720 | A1 * | 12/2004 | Koski | 362/253 |

(Continued)

*Primary Examiner* — Jason Moon Han
*Assistant Examiner* — Omar Rojas Cadima
(74) *Attorney, Agent, or Firm* — Baker Donelson; Dorian B. Kennedy

(57) ABSTRACT

There is disclosed a cooking hood LED light (10) which is mounted to a cooking hood positioned above a cooking surface. The LED light 10 includes a main housing (11), a reflector assembly (12), an LED lighting circuit (13), and a cover plate (14). The reflector assembly includes a bottom wall having a square opening (34) therein from which extends a truncated pyramid shaped light reflector (35). The cover plate has a square central opening (42) housing a safety glass (47). The LED lighting circuit includes an LED array light panel (51) and an LED power supply (50). The light panel includes an array of LED light elements (54). A clear lens plate (55) having downwardly depending rounded lens tips (56) is coupled to the light panel. A metal heat sink (58) is thermally coupled to the light panel to dissipate heat produced by the light panel.

8 Claims, 3 Drawing Sheets

(56) References Cited

U.S. PATENT DOCUMENTS

2007/0257335 A1* 11/2007 O'Brien ..... 257/618
2007/0268707 A1* 11/2007 Smester ..... 362/362
2008/0278950 A1* 11/2008 Pickard et al. ..... 362/294
2009/0180281 A1* 7/2009 Ahland et al. ..... 362/234
2010/0177514 A1* 7/2010 Liu ..... F21S 4/008 362/235
2011/0038150 A1* 2/2011 Woodgate et al. ..... 362/235

* cited by examiner

COOKING HOOD LED LIGHT

TECHNICAL FIELD

This invention relates generally to a light, and more particularly to an LED light which is adapted to be mounted to a hood above a cooking surface.

BACKGROUND OF INVENTION

Light fixtures with light bulbs mounted thereto have existed for many years. Oftentimes, light fixtures are mounted within an exhaust hood mounted above a cooking surface to illuminate the cooking surface. In today's commercial kitchens, regulations are in place that mandate the lighting and the illumination therefrom for commercial cooking surfaces.

Typically, such hood mounted lights are fitted with incandescent light bulbs. However, these incandescent lights are not energy efficient. As such, a more energy efficient illumination device would be desired to replace the use of incandescent light bulbs in this environment. LED type lights would provide a more efficient means of illuminating the cooking surface. The problem is that LED lights do not provide the even coverage mandated for commercial cooking surfaces. Additionally, the heat of the LED lights in combination with the heat from he cooking surface can cause damage to the electronics which power the LED lights.

Accordingly, it is seen that a need remains for an energy efficient light which can be mounted above a cooking surface while providing adequate illumination of the cooking surface. It is to the provision of such therefore that the present invention is primarily directed.

SUMMARY OF THE INVENTION

In a preferred form of the invention an LED light for a kitchen hood comprises a housing having a top wall and side walls depending downwardly from the top wall, a light reflector assembly coupled to the housing, the light reflector assembly including a truncated four sided pyramid shaped reflector having a top end and a bottom end, an array of LED light elements positioned at the light reflector top end, a cover plate removably coupled to the housing, a safety glass coupled to the cover plate, and a power supply circuit electrically coupled to the array of LED light elements.

DETAILED DESCRIPTION

Figure 1:
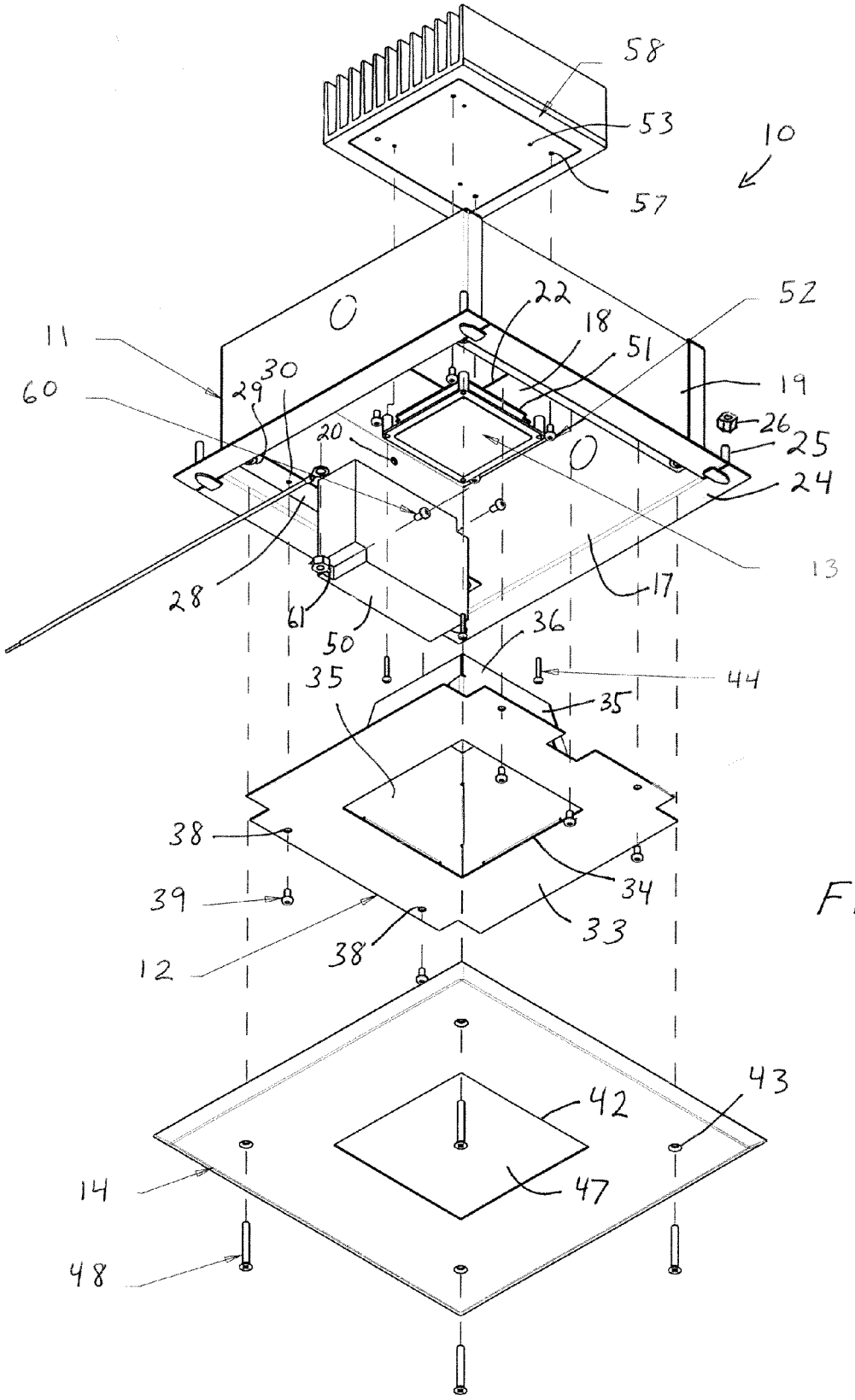
FIG. 1 is a perspective, exploded view of a cooking hood LED light embodying principles of the invention in a preferred form.
Figure 2:
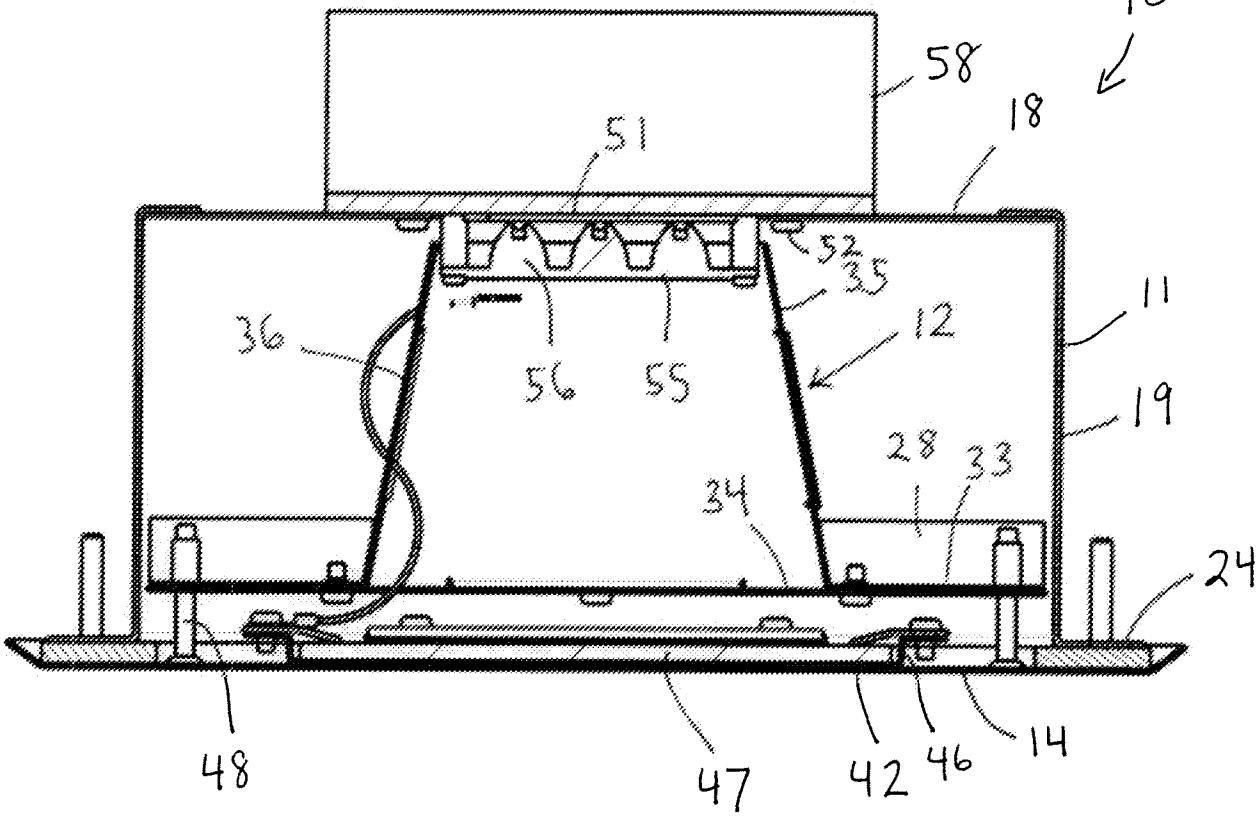
FIG. 2 is a cross-sectional view of the cooking hood LED light of FIG. 1.
Figure 3:
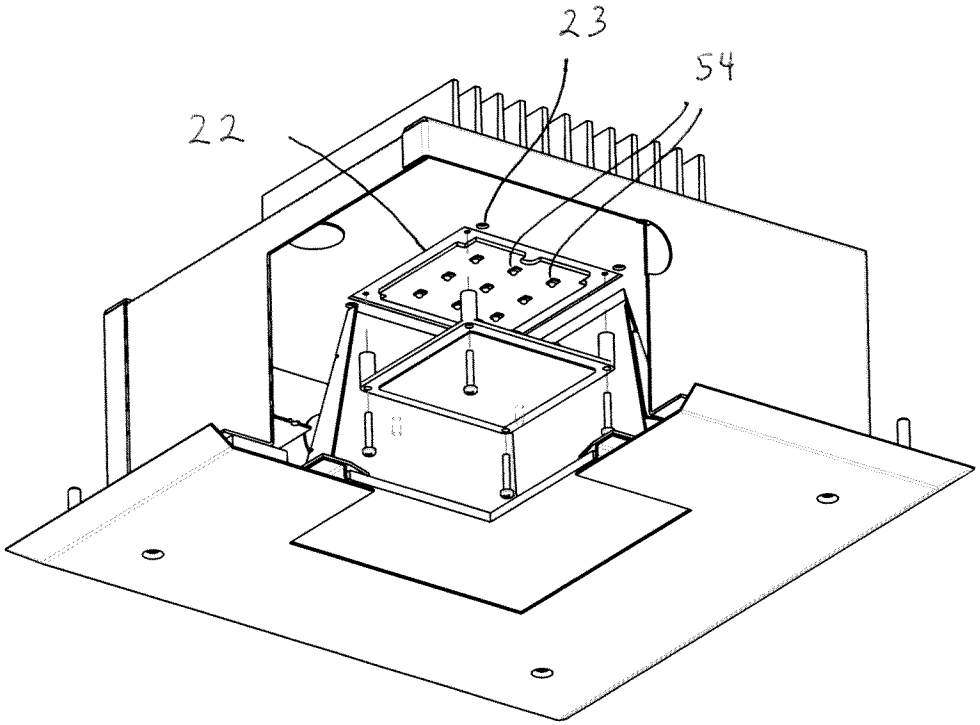
FIG. 3 is perspective view, partially exploded, of the cooking hood LED light of FIG. 1.
Figure 4:
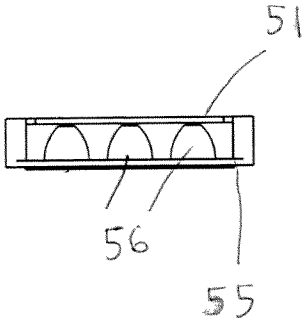
FIG. 4 is a side view of the lens plate of the cooking hood LED light of FIG. 1.

With reference next to the drawings, there is shown a cooking hood LED light 10 according to the present invention. The LED light 10 is typically mounted to a cooking hood positioned above a cooking surface. The LED light 10 includes a main housing portion, enclosure, or housing 11, a reflector assembly 12 coupled to the housing 11, an LED lighting circuit 13 contained within the housing, and a cover plate 14 coupled to the housing 11.

The housing 11 is generally box-shaped with an open bottom end 17. The housing 11 includes a generally square shaped top or base wall 18 from which extends four side walls 19, which in combination define a housing interior within the confines of the base wall and side walls and a housing exterior opposite the housing interior. One side wall 19 has two diagonally offset screw mounting holes 20 therein. The base wall 18 has a central square shaped, cut-out or opening 22 and four screw mounting holes 23 adjacent the opening 22. The four side walls 19 have outwardly extending bottom lips or flanges 24 which are configured to abut the underlying cover plate 14. The bottom flanges 24 have four threaded posts 25 which accept internally threaded nuts 26 thereon. The housing 11 also includes two inwardly extending interior mounting flanges 28 coupled to the interior of the side walls 19 above the bottom edge of the side walls 19 and the adjoining bottom flanges 24. Each interior mounting flange 28 has two outboard screw mounting holes 9 d three inboard screw mounting holes 30 therein.

The reflector assembly 12 includes a bottom wall or access panel 33 having a generally square opening 34 therein from which upwardly extends an open ended, four sided, truncated or frusto-pyramid shaped light reflector 35. Each reflector wall 36, which forms the reflector 35, is preferably and generally an isosceles trapezoid in shape and is set at an angle so at to tilt inwardly as it extends upwardly. The bottom wall 33 has four screw mounting holes 38 therein which align with internal flange mounting holes 30. A mounting screw 39 passes through each mounting hole 38 and 30 to secure the reflector assembly 12 to the housing 11.

The cover plate 14 has a square central opening 42 which is configured to generally match or align with the reflector access panel opening 34. The cover plate 14 also has four screw mounting holes 43 which align with interior flange screw mounting holes 29 to removably secure the cover plate 14 to the main housing 11. Four safety glass mounting brackets 46 are mounted to the top surface of the cover plate, which hold in place a safety glass 47 adjacent the cover plate central opening 42. The safety glass 47 is preferably a tempered safety glass which is capable of withstanding the impact of at least 3 ft-lb. Four mounting screws 48 pass through cover plate mounting holes 43 and into interior flange screw mounting holes 29 to hold the cover plate 14 to the housing 11.

The LED lighting circuit 13 includes an LED array light panel 51 and an LED power supply 50 which conventionally includes the LED drivers, a power transformer, and other conventional electronics required to operate LED type lights. The LED power supply preferably provides an output voltage of 48 VDC. The LED light is under current regulations to provide at least 50 candles upon the underlying cook top surface located at a distance of 66 inches below the light and within a four foot by four foot square area. The LED array light panel 51 may include many different number and configuration of LED lights, however, the preferred embodiment includes an array of four LED light elements 54 by four LED light elements 54 for a total of sixteen LED light elements. The LED array light panel is positioned within the housing opening 22 and secured thereto by screws 52 passing through screw mounting holes 23 and into screw mounting holes 53 in a heat sink 58 in combination with a clear lens plate 55 coupled to the light panel 51 through mounting screws 44 passing through the lens plate and into mounting holes 57 in the heat sink. The lens plate 55 has an array of downwardly depending rounded lens tips 56 aligned with each LED light element 54 of the light panel. Each lens tip 56 is generally round with an internal channel to better distribute the light produced by the LED light. The heat sink 58 is preferably finned and thermally coupled to the backside of the light panel 51 to dissipate heat produced by the light panel. The heat sink 58 is positioned externally of the housing, i.e., within the housing exterior. The power supply 50, is coupled to the interior surface of the housing side wall 19 through screws 60 passing through screw mounting holes 61 within the electronics and aligned with mounting screw holes 20.

In use, the electronics must be maintained at a temperature that will not harm the electronic components. This is accomplished by mounting the electronics (power supply 50) against the cooler side walls of the housing. This is further enhanced by the reflector assembly which is positioned between the LED light elements 54 and the electronics (power supply 50) to shield it from the heat produced by the LED light elements.

The cooking hood LED light 10 is mounted to a kitchen hood by placing it within a cut out within the hood which includes four post mounting holes configured to accept the four threaded posts 25 extending from the housing bottom flanges. The nuts 26 are then threaded onto the posts 25 to secure the housing in place. The cover plate 14 is then coupled to the housing 11 by passing mounting screws 48 through mounting screw holes 43 and 29.

The light produced from the LED light panel 51 is efficiently distributed or scattered by the lens plate 55. This light is then controlled by the configuration of the reflector 35, i.e., the light reflection off the reflector walls 36, upon the cook top surface in a manner consistent with current regulations. The shape or configuration of the reflector effectively funnels the light so that it produces a generally square light pattern with an even distribution of light throughout the pattern, which has been difficult to achieve with the intense spot type lights produced through LED light elements.

It thus is seen that a kitchen hood LED light is now provided which overcomes problems associated with the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. An LED light for a kitchen hood comprising, a housing mountable in a kitchen hood, the housing having a top wall spanning between side walls depending downwardly from said top wall to define a housing interior space and a housing exterior space;

a light reflector assembly coupled to said housing, said light reflector assembly including a truncated four sided pyramid shaped reflector having a top end positioned closely adjacent said housing top wall and a bottom end positioned closely adjacent a bottom portion of said housing side wall and being separated from said housing to define a chamber between said light reflector and said housing defined by said side walls, said light reflector assembly and said top wall;

a LED light panel having an array of LED light elements positioned at said light reflector top end, said LED light panel in combination with said light reflector enclosing said top end of said light reflector to restrict heat generated by said LED light elements from reaching said housing;

a heat sink positioned within said housing exterior space and in direct contact with said LED light panel;

a cover plate removably coupled to said housing;

a safety glass coupled to said cover plate, and a power supply circuit electrically coupled to said array of LED light elements.

2. The LED light for a kitchen hood of claim 1 further comprising a lens plate positioned adjacent said array of LED light elements.

3. The LED light for a kitchen hood of claim 2 wherein said lens plate includes an array of lens tips, wherein each lens tip is associated with one LED light element.

4. An LED light for a kitchen hood comprising, a housing mountable in a kitchen hood, the housing having a top wall spanning between side walls depending downwardly from said top wall defining a housing interior space and a housing exterior space;

a light reflector assembly coupled to said housing within said housing interior and extending between a bottom portion of said housing and a top portion of said housing and being separated from said housing to define a chamber between said light reflector and said housing defined by said side walls, said light reflector assembly and said top wall;

a LED light panel having an array of LED light elements positioned at a top end of said light reflector, said LED light panel in combination with said light reflector enclosing a top end of said light reflector to restrict heat generated by said LED light elements from reaching said housing;

a heat sink thermally coupled and in direct contact with said LED light panel, said heat sink being positioned within said housing exterior space;

a cover plate coupled to said housing, and a power supply circuit electrically coupled to said array of LED light elements.

5. The LED light for a kitchen hood of claim 4 further comprising a safety glass coupled to said cover plate.

6. The LED light for a kitchen hood of claim 4 further comprising a lens plate positioned adjacent said array of LED light elements.

7. The LED light for a kitchen hood of claim 6 wherein said lens plate includes an array of lens tips, wherein each lens tip is associated with one LED light element.

8. The LED light for a kitchen hood of claim 4 wherein said light reflector assembly including a truncated four sided pyramid shaped reflector.

* * * * *